US007327267B2

(12) United States Patent
Tsunoda

(10) Patent No.: US 7,327,267 B2
(45) Date of Patent: Feb. 5, 2008

(54) VENDING MACHINE

(75) Inventor: Masaru Tsunoda, Isesaki (JP)

(73) Assignee: Sanden Corporation, Gunma (JP)

( * ) Notice: Subject to any disclaimer, the term of this patent is extended or adjusted under 35 U.S.C. 154(b) by 182 days.

(21) Appl. No.: 11/365,918

(22) Filed: Mar. 2, 2006

(65) Prior Publication Data

US 2006/0208851 A1 Sep. 21, 2006

(30) Foreign Application Priority Data

Mar. 4, 2005 (JP) ..... 2005-060112

(51) Int. Cl.
*G08B 13/14* (2006.01)

(52) U.S. Cl. ..... 340/572.8; 340/572.1; 340/572.4; 340/5.9

(58) Field of Classification Search ..... 340/572.1, 340/572.4, 572.8, 572.9, 5.9, 5.91, 5.92; 235/381, 385, 375; 705/22, 16, 28
See application file for complete search history.

(56) References Cited

U.S. PATENT DOCUMENTS 4,108,363 A * 8/1978 Susumu ..... 235/383
4,800,254 A * 1/1989 Suzuki et al. ..... 235/380
6,193,154 B1 * 2/2001 Phillips et al. ..... 235/381
6,917,853 B2 * 7/2005 Chirnomas ..... 700/244
7,185,809 B2 * 3/2007 Barton et al. ..... 235/383
7,213,753 B2 * 5/2007 Barton et al. ..... 235/383

FOREIGN PATENT DOCUMENTS

JP 11154266 6/1999

* cited by examiner

*Primary Examiner*—Van T. Trieu
(74) *Attorney, Agent, or Firm*—Baker Botts L.L.P.

(57) ABSTRACT

A vending machine reads a commodity data on a commodity from a QR code of a commodity housing unit by a code reader of a commodity receiving unit when the commodity receiving unit receives the commodity from a predetermined commodity housing unit selects an operation mode of the commodity receiving unit in accordance with the read commodity data, and operates the commodity receiving unit in accordance with the selected operation mode.

6 Claims, 15 Drawing Sheets

VENDING MACHINE

BACKGROUND OF THE INVENTION (i) Field of the Invention

The present invention relates to a vending machine for selling commodities such as packaged beverages in accordance with a selling request.

(ii) Description of the Related Art

A general vending machine using a serpentine rack as a commodity housing unit operates a vent mechanism of the predetermined rack in accordance with a selling request, drops a lowest commodity in the rack on a tilted chute, moves the commodity dropped on the tilted chute downward along the tilt, and conveys the commodity to a commodity takeout port. Though this type of the vending machine has an advantage that it does not require a complex mechanism to convey the commodity to the commodity takeout port, an impact noise when the commodity drops is large as well as the commodity may be damaged by an impact when the commodity drops.

In view of the above situation, a vending machine is also proposed which has a commodity conveying unit for directly receiving a commodity from a commodity housing unit and conveying the commodity to a predetermined position such as a commodity takeout port.

In the vending machine having the commodity conveying unit, it is necessary to change operation modes of the commodity conveying unit in accordance with the size, shape, or type of the commodity so as to receive and convey the commodity in an optimum state.

For example, in a vending machine using a conveyer rack or tilted rack for housing the commodities by longitudinally arranging them in an erect state as the commodity housing unit and using a mechanism constituted so that a receiving unit such as a bucket or hand capable of receiving the commodity can be moved as the commodity conveying unit; or a vending machine using a serpentine rack or other direct loading rack constituted so as to be movable as the commodity housing unit and using a mechanism constituted so that a receiving unit such as a bucket capable of receiving the commodity can be moved as the commodity conveying unit; it is necessary to select an operation mode of the receiving unit in conformity with the commodity so that the commodity can be received and conveyed in an optimum state.

Generally, part number data for specifying commodities is input and stored in a memory at a stage of housing the commodities in the commodity housing units. However, to select the operation mode of the receiving unit in conformity with the commodity, it is necessary to at least input and store size data of the commodities together. However, a large number of types of the commodities are handled by one vending machine and a replacement frequency of the commodities is high. Therefore, to store necessary and sufficient commodity data corresponding to all of the commodities, the memory having a large capacity and an input time corresponding to data quantity are necessary.

SUMMARY OF THE INVENTION

An object of the present invention is to provide a vending machine making it possible to receive and convey a commodity in an optimum state.

To achieve the above object, a vending machine of the present invention comprises: a plurality of commodity housing units; a commodity conveying unit for conveying a commodity received from a predetermined commodity housing unit to a predetermined position; a plurality of data recording portions being provided with the commodity housing units respectively, the data recording portions each having commodity data corresponding to the commodity in each of the commodity housing units; data reading means being provided with the commodity conveying unit, the data reading means capable of reading the commodity data from one of the data recording portions; mode selecting means for selecting an operation mode of the commodity conveying unit in accordance with the commodity data which is read by the data reading means; and operation control means for operating the commodity conveying unit in accordance with the operation mode which is selected by the mode selecting means.

According to this vending machine, when a commodity conveying unit receives a commodity from a predetermined commodity hosing unit, it is possible to read the commodity data on the commodity from the data recording portion of the commodity housing unit by the data reading means of the commodity conveying unit, select an operation mode of the commodity housing unit in accordance with the read data, and operate the commodity conveying unit in accordance with the selected operation mode. That is, it is possible to obtain the commodity data required to select an operation mode of the commodity conveying unit from the data recording portion of the commodity housing unit. Therefore, it is not necessary to previously input and store the commodity data in a memory. Moreover, even when replacing commodities, it is possible to obtain the commodity data same as the above by replacing the data recording portion with another data recording portion corresponding to a replaced commodity.

The above object and other objects, features, and advantages will become apparent in accordance with the following description and accompanying drawings.

DESCRIPTION OF THE PREFERRED EMBODIMENTS

First Embodiment

FIGS. 1 to 10 show an embodiment in which the present invention is applied to a vending machine using a conveyer rack as a commodity housing unit.

Figure 1:
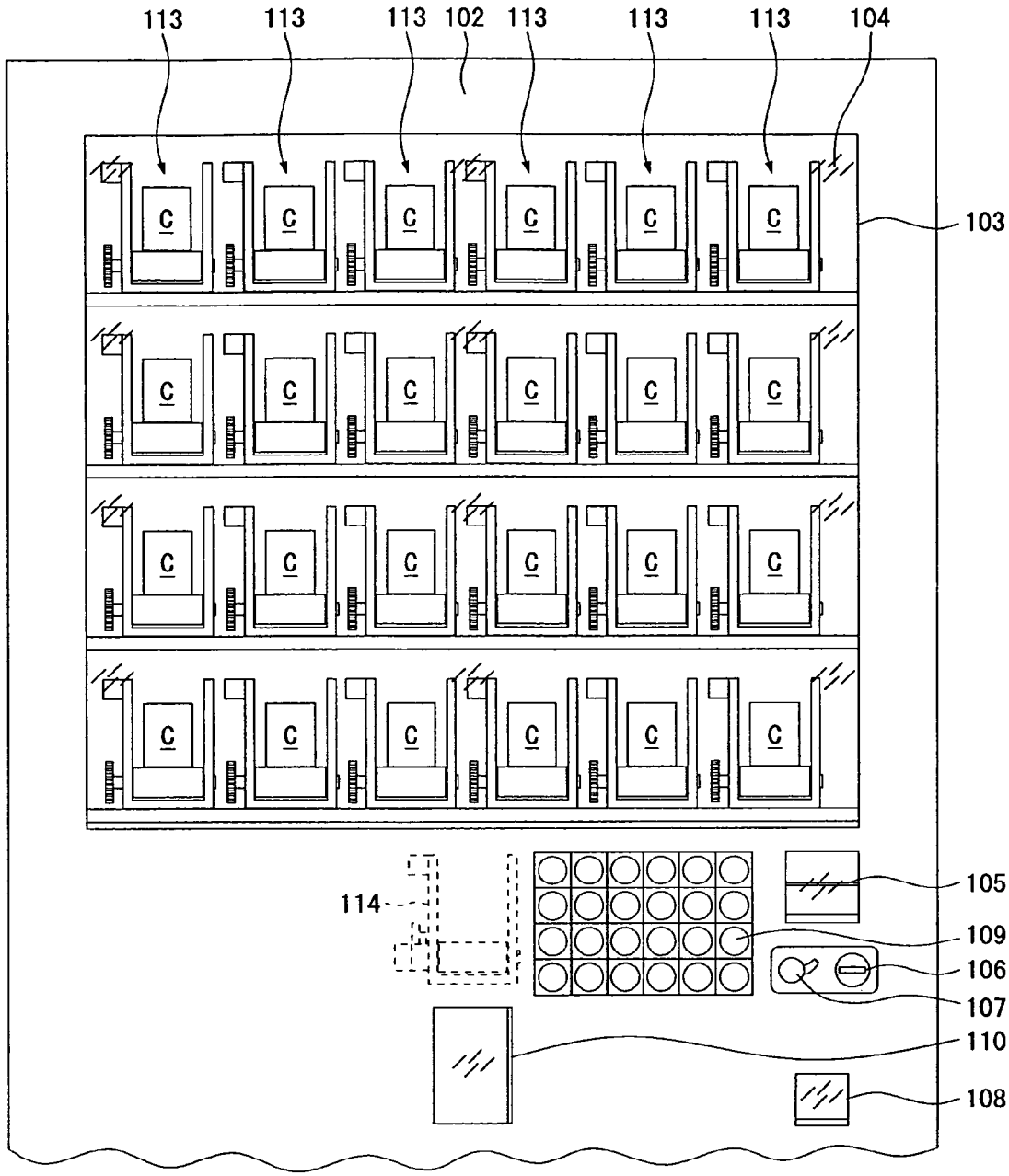
FIG. 1 is a front view of an essential portion of the vending machine showing a first embodiment of the present invention.
Figure 2:
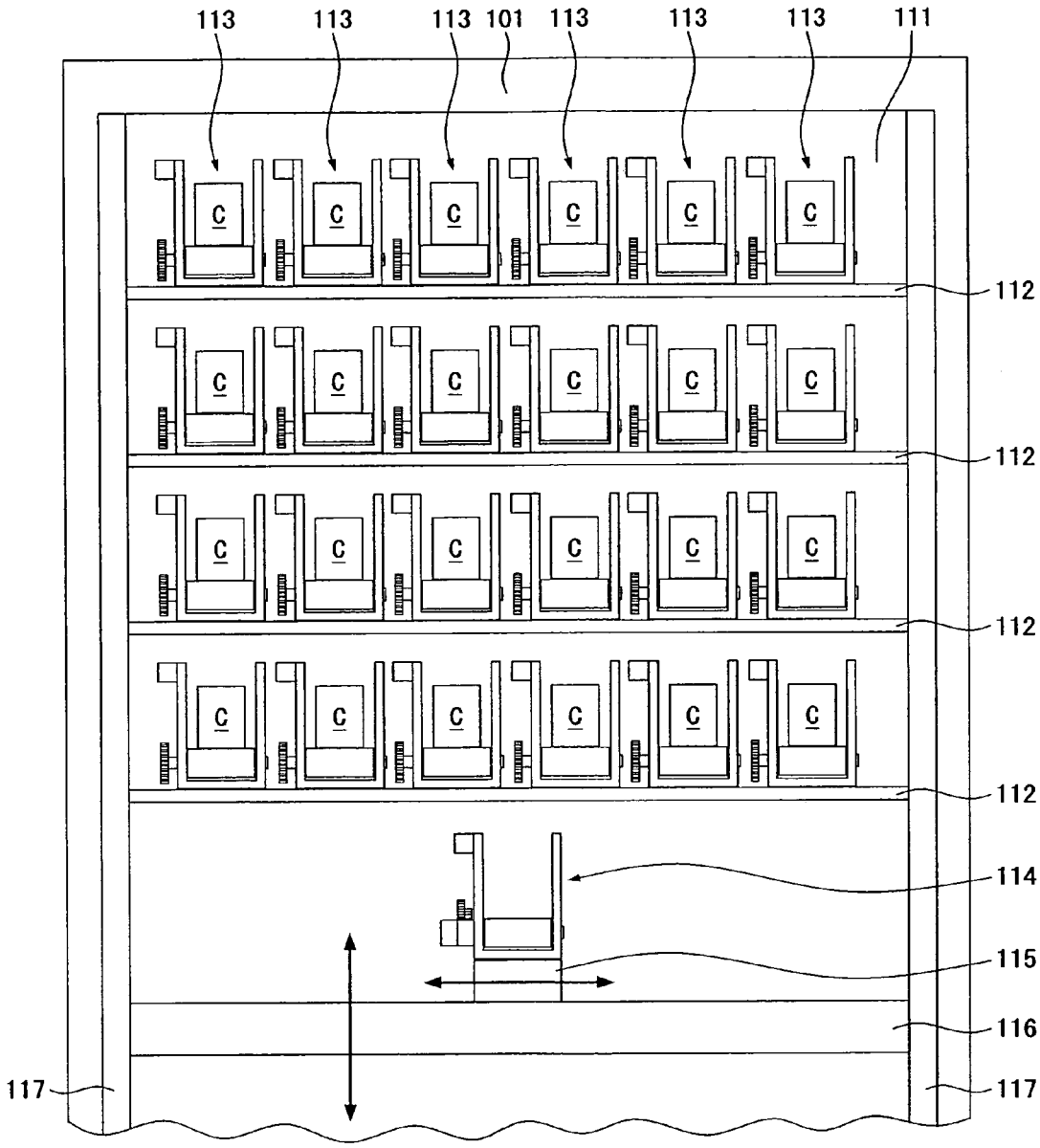
FIG. 2 is an illustration excluding a door from FIG. 1.
Figure 3:
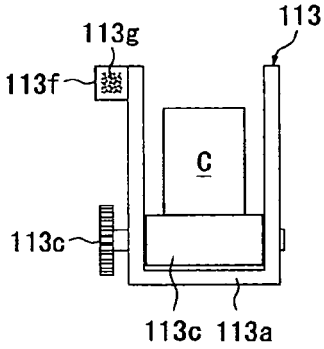
FIG. 3A is a front view of a commodity housing unit of the vending machine shown in FIG. 1.
FIG. 3B is a side view of the commodity housing unit of the vending machine shown in FIG. 1.
Figure 3:
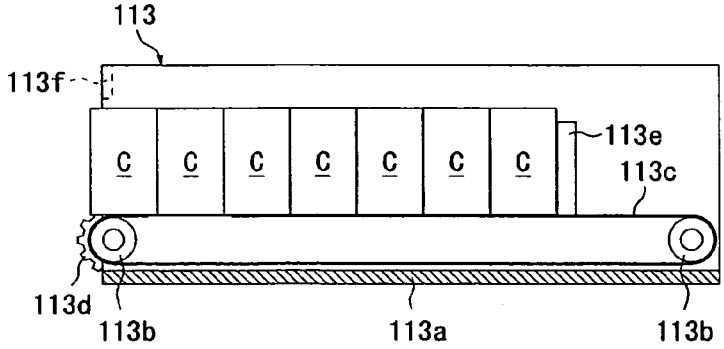
Figure 4:
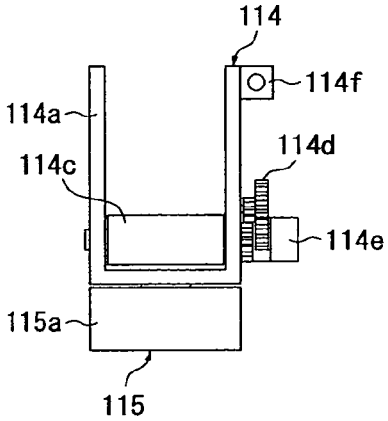
FIG. 4A is a back view of a commodity receiving unit of the vending machine shown in FIG. 1.
FIG. 4B is a side view of the commodity receiving unit of the vending machine shown in FIG. 1.
Figure 4:
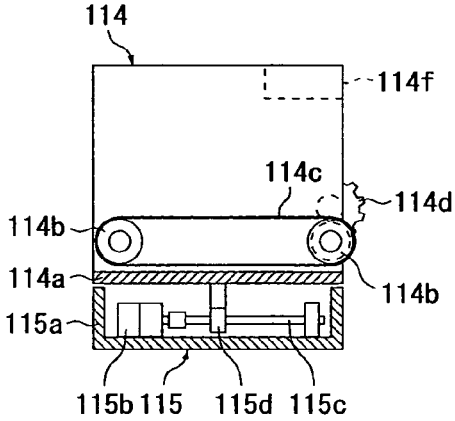

First, a mechanism of the vending machine is described by referring to FIGS. 1 to 4. FIG. 1 is a front view of an essential portion of the vending machine, FIG. 2 is an illustration excluding a door from FIG. 1, FIG. 3A is a front view of the commodity housing unit of the vending machine shown in FIG. 1, FIG. 3B is a side view of the commodity housing unit of the vending machine shown in FIG. 1, FIG. 4A is a back view of the commodity receiving unit of the vending machine shown in FIG. 1, and FIG. 4B is a side view of the commodity receiving unit of the vending machine shown in FIG. 1.

This vending machine has a boxy cabinet 101 whose front opens and the door 102 for covering the front opening of the cabinet 101 so that the opening can be opened or closed. A rectangular window hole 103 is formed on the door 102. A transparent plate 104 made of plastic, glass or the like is provided with the window hole 103. A bill slot 105, coin slot 106, coin return lever 107, coin returning port 108, selection button 109, and commodity takeout port 110 are provided on the door 102.

The cabinet 101 includes an adiabatic chamber 111. A plurality of shelf boards 112 (four boards in FIGS. 1 to 4) are provided in the adiabatic chamber 111 by vertically keeping intervals. A plurality of commodity housing units 113 (six units in FIGS. 1 to 4) are provided on each shelf board 112 by horizontally keeping intervals.

Each commodity housing unit 113 has a frame 113*a* whose cross section is horseshoe-shaped, pulley 113*b* rotatably provided with the front and rear ends of the frame 113*a*, an endless belt 113*c* wound on a pair of pulleys 113*b*, driven gear 113*d* which is provided with the shaft end of the front pulley 113*b* and a part of which is protruded frontward, support plate 113*e* fixed to the belt 113*c*, and display plate 113*f* set so as to face the transparent plate 104 at the upper portion of the front end of the frame 113*a*. The commodities C are put on the belt 113 by arranging them in the longitudinal direction.

A plurality of two-dimensional code (hereinafter referred to as QR code) 113*g* are removably provided with the commodity housing units 113 respectively in the form of a seal or plate. Each QR code 113*g* has a commodity data including a shape, size, and type corresponding to the commodity C in each of the commodity housing units 113. This QR code 113*g* corresponds to "data recording portion" in claims. In FIGS. 1 to 4, a reference character C is provided for commodities housed in all commodity housing units 113. The reference character C does not denote that shape, size, and type are the same. That is, the commodities in which shape, size, and type are properly different are housed in each commodity housing unit 113.

Moreover, the commodity receiving unit 114 is arranged in a space formed between each shelf plate 112 and the door of the cabinet 101. A first driving unit 115 for longitudinally moving the commodity receiving unit 114 is arranged under the commodity receiving unit 114. A second driving unit 116 for horizontally moving the first driving unit 115 is arranged under the first driving unit 115. A third driving unit 117 for vertically moving the second driving unit 116 is arranged at the both sides of the second driving unit 116. These commodity receiving unit 114, first driving unit 115, second driving unit 116, and third driving unit 117 correspond to "commodity conveying unit" in claims.

The commodity receiving unit 114 has a frame 114*a* whose cross section is U-shaped, pulley 114*b* rotatably provided with the front and rear ends of the frame 114*a*, endless belt 114*c* wound on a pair of pulleys 114*b*, driving gear 114*d* provided with the shaft end of the rear pulley 114*b*, reducer-provided motor 114*e* whose rotational shaft is connected to the shaft end of the front pulley 114*b*, and code reader 114*f* provided with the upper portion of the rear end of the frame 114*a*. The driving gear 114*d* is constituted of two gears engaged with each other and one gear rotates in the same direction as the rear pulley 114*b* and the other gear rotates in the reverse direction to the rear pulley 114*b*. The other gear can be engaged with the driven gear 113*d* of each commodity housing unit 113 and a part of which is protruded backward.

The code reader 114*f* is constituted of a CDD camera, CMOS camera or the like and is able to read the commodity data from the QR code 113*g* of each commodity housing unit 113. The code reader 114*f* corresponds to "data reading means" in claims.

The first driving unit 115 has a frame 115*a*, reducer-provided motor 115*b*, ball screw 115*c* connected to the rotational shaft of the motor 115*b*, nut 115*d* which is screwed to the ball screw 115*c* and an end of which is connected to the frame 114*a* of the first driving unit 114, and guide mechanism (not illustrated) for guiding the horizontal movement of the first driving unit 114.

The second driving unit 116 has a frame (with no symbol), reducer-provided motor 116*a* (refer to FIG. 5), ball screw (not illustrated) connected to the rotational shaft of the motor 116*b*, nut (not illustrated) which is screwed to the ball screw and one end of which is connected to the frame 115*a* of the first driving unit 115, and guide mechanism. (not illustrated) for guiding the horizontal movement of the first driving unit 115.

The third driving unit 117 has a frame (with no symbol), reducer-provided motor 117*a* (refer to FIG. 5), driving pulley (not illustrated) connected to the rotational shaft of the motor 117*b*, driven pulley (not illustrated) provided with the upper side of the driving pulley, endless belt (not illustrated) which is wound on the both pulleys and a part of which is connected to the frame of the second driving unit 116, and guide mechanism (not illustrated) for guiding the vertical movement of the second driving unit 116.

It is also allowed that a combination of a ball screw and a nut used for each of the driving units 115, 116, and 117 is constituted of another movement converting means constituted of a combination of a driving pulley connected to the rotational shaft of a motor, driven pulley, and endless belt wound on the pulleys.

Moreover, an evaporator for cooling commodities (not illustrated), electric heater (not illustrated), and fan (not illustrated) for circulating cooled air or heated air are set in the cabinet 101.

Figure 5:
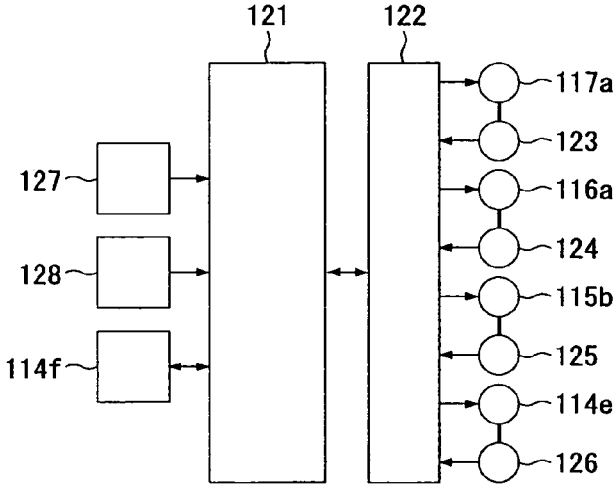
FIG. 5 is an illustration showing a control system of the vending machine shown in FIG. 1.

Then, a control system of the vending machine is described by referring to FIG. 5.

Reference numeral 121 in FIG. 5 denotes a control portion constituted of a microcomputer, reference numeral 122 denotes a motor driving portion, reference numeral 123 denotes an encoder connected to the rotational shaft of the motor 117*a* of the third driving unit 117, reference numeral 124 denotes an encoder connected to the rotational shaft of the motor 116*a* of the second driving unit 116, reference numeral 125 denotes an encoder connected to the rotational shaft of the motor 115*b* of the first driving unit 115, reference numeral 126 denotes an encoder connected to the rotational shaft of the motor 114*e* of the commodity receiving unit 114, reference numeral 127 denotes a money processing unit, reference numeral 128 denotes a commodity selecting unit, and reference numeral 114*f* denotes the code reader of the commodity receiving unit 114.

Figure 10:
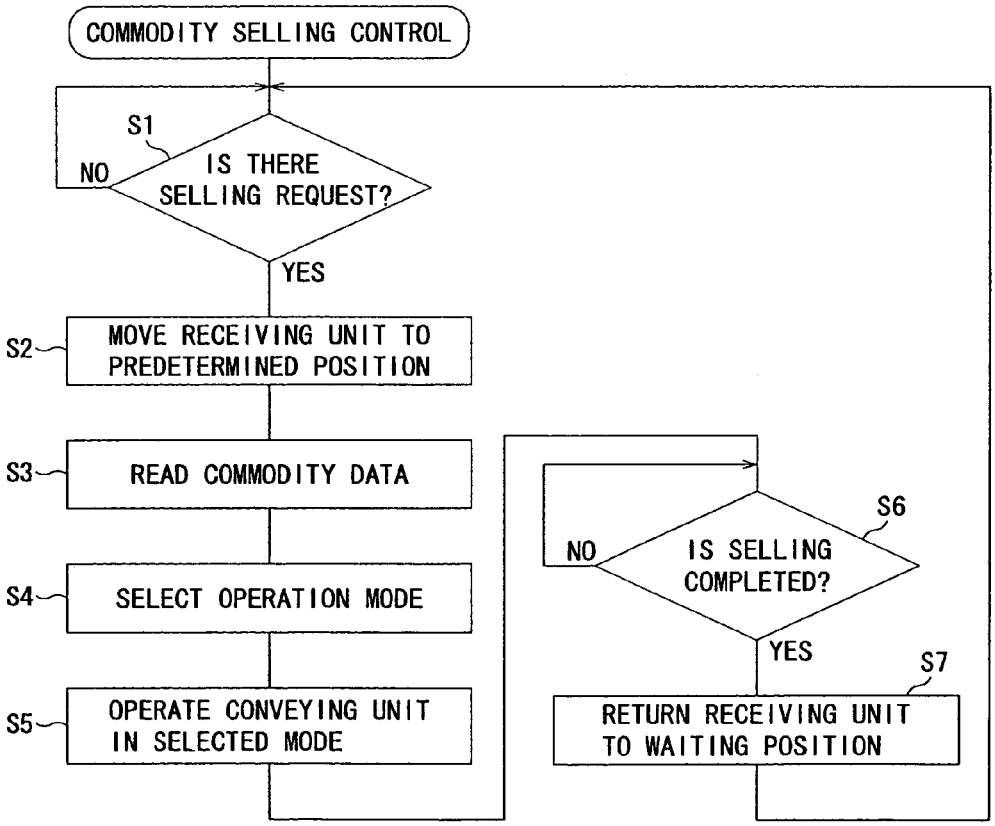
FIG. 10 is an illustration showing a program flow of a commodity selling control of the vending machine shown in FIG. 1.

The program for commodity selling control shown in FIG. 10 is stored in the memory of the control portion 121 and stop position data for the commodity receiving unit 114 for commodity conveyance is stored in the memory as two-dimensional coordinates (coordinates expressed by X showing horizontal position and Z showing vertical position). The motor driving portion 122 transmits a driving signal to the motors 117*a*, 116*a*, 115*b*, and 114*e* in accordance with a control signal from the control portion 121 and transmits detection signals by the encoders 123, 124, 125, and 126 to the control portion 121.

The money processing unit 127 includes the bill slot 105 and coin slot 106 arranged on the door 102 to perform authenticity determination of inserted money, amount-of-money detection, and storage and transmits a signal for detected amount of money to the control portion 121. The commodity selecting unit 128 includes the selection button 109 arranged on the door 102 and transmits a selection signal according to the operation of the selection button 109 to the control portion 121.

Then, a selling operation of the commodity is described by referring to FIGS. 6 to 10.

Figure 6:
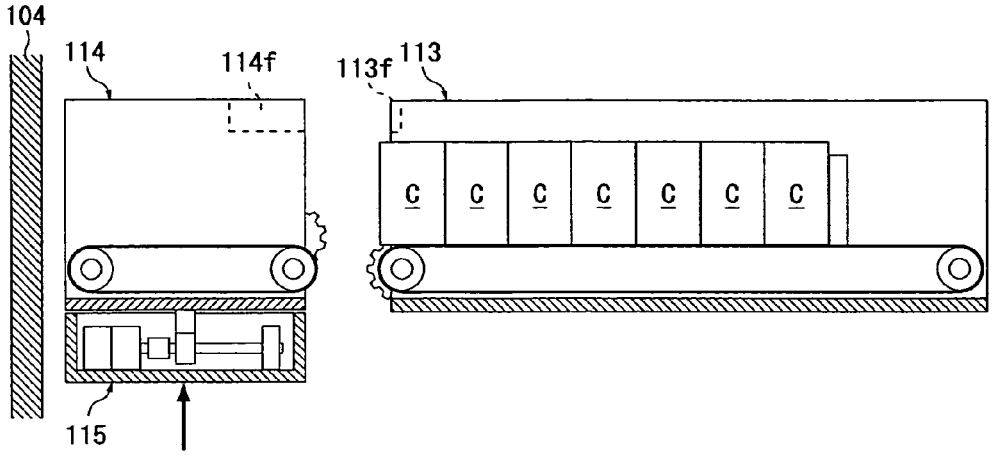
FIG. 6 is an illustration of a commodity selling operation of the vending machine shown in FIG. 1.

When a selling request is transmitted in accordance with money insertion and selection button operation, by the operations of the motor 116*a* of the second driving unit and the motor 117*a* of the third driving unit 117 as shown in FIG. 6, the commodity receiving unit 114 at a waiting position moves to a correct position in the longitudinal direction to the commodity housing unit 113 for housing the commodity C according to a selling request and stops (steps S1 and S2 in FIG. 10).

After the commodity receiving unit 114 stops, the unit 114 recognizes the QR code 113*g* of the commodity housing unit 113 by the code reader 114*f* while performing dedicated illumination according to necessity, reads the commodity data (data including at least size of commodity) from the QR code 113*g*, and selects an operation mode of the commodity conveying unit in accordance with the commodity data which is read by the code reader 114*f* (steps S3 and S4 in FIG. 10).

An "operation mode" selected in this stage is moving distances of the belts 113*c* and 114*c* (refer to FIG. 8) when moving the commodity C to the commodity receiving unit 114 from the commodity housing unit 113 and the moving distance of the belt 114*c* (refer to FIG. 9) after the commodity C moves to the commodity receiving unit 114. That is, these moving distances are selected as values optimum for the commodity C.

Figure 7:
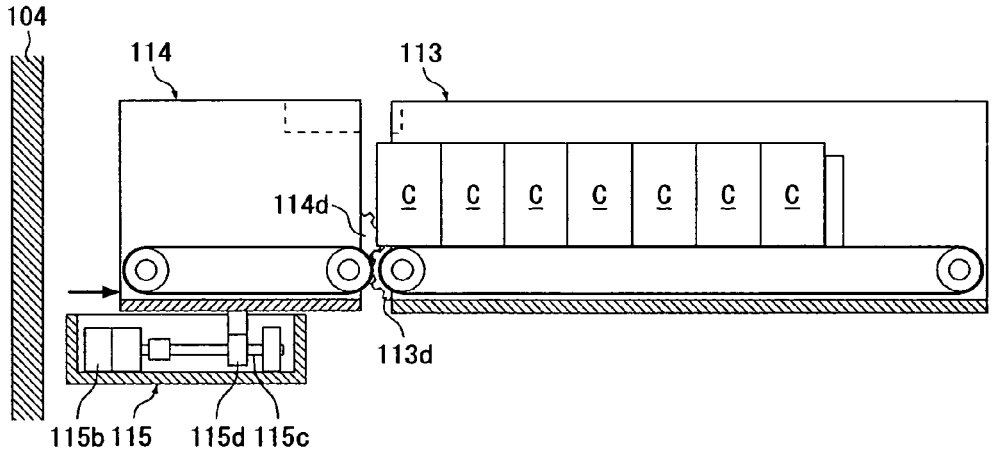
FIG. 7 is an illustration of the selling operation of the vending machine shown in FIG. 1.
Figure 8:
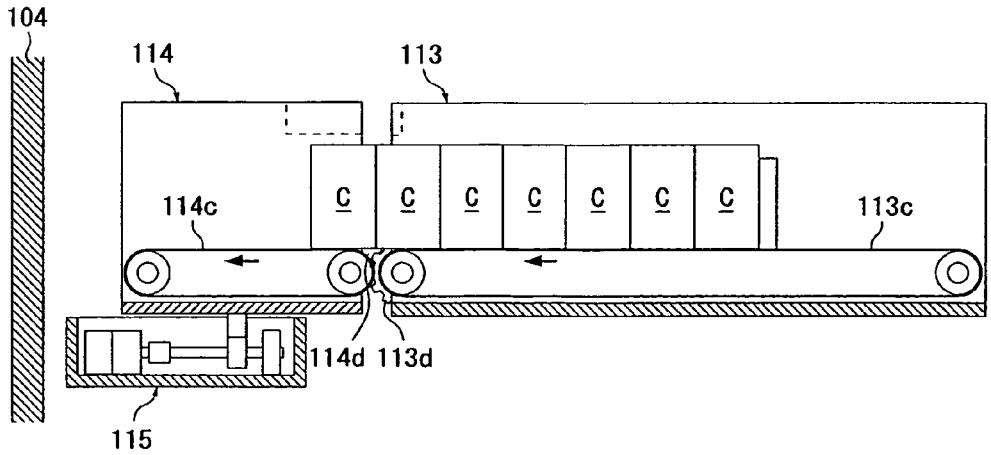
FIG. 8 is an illustration of the commodity selling operation of the vending machine shown in FIG. 1.

After reading the commodity data, the commodity receiving unit 114 backs by a predetermined distance in accordance with the operation of the motor 115*b* of the first driving unit 115 as shown in FIG. 7 and the driving gear 114*d* gears with the driving gear 113*d* of the commodity housing unit 113.

After the commodity receiving unit 114 backs, the belt 114*c* of the commodity receiving unit 114 rotates counterclockwise in accordance with the operation of the motor 114*e* of the commodity receiving unit 114, the belt 113*c* of the commodity housing unit 113 is rotated by a gear in the same direction in accordance with the motive power, the both belts 113*c* and 114*c* move by a previously selected distance, the commodity C at the foremost end of the commodity housing unit 113 moves to the belt 114*c* of the commodity receiving unit 114. In this connection, the moving distance conforms to the anteroposterior dimension of the commodity C. The moving distance of a commodity having an anteroposterior dimension larger than that of the illustrated commodity C is larger than that of the commodity C and the moving distance of a commodity having an anteroposterior dimension smaller than the illustrated commodity C is smaller than that of the commodity C.

Figure 9:
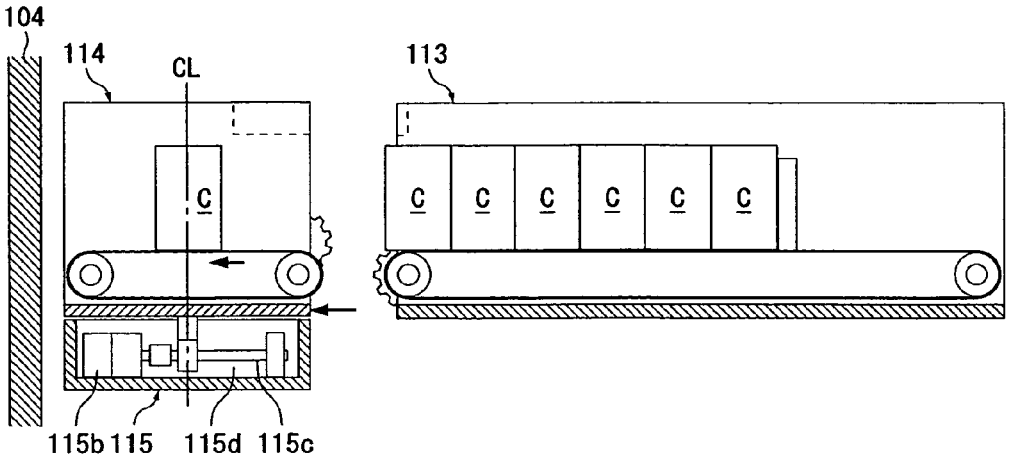
FIG. 9 is an illustration of the commodity selling operation of the vending machine shown in FIG. 1.

After the commodity C moves to the commodity receiving unit 114, by the operation of the motor 115*b* of the first driving unit 115 the commodity receiving unit 114 advances by a predetermined distance and gearing between the driving gear 114*d* and the driven gear 113*d* of the commodity housing unit 113 is canceled as shown in FIG. 9. After the commodity receiving unit 114 advances, the belt 114*c* of the commodity receiving unit 114 is rotated by the operation of the motor 114*e* counterclockwise, the belt 114*c* moves by a previously-selected distance, and the moved commodity C moves to the anteroposterior-directional center CL of the commodity receiving unit 114 (belt 114*c*) and stops. In this connection, this moving distance conforms to the anteroposterior dimension of the commodity C. The moving distance of a commodity having a anteroposterior dimension larger than that of the illustrated commodity C is smaller than that of the commodity C and the moving distance of a commodity having a anteroposterior dimension smaller than that of the illustrated commodity C is larger than that of the commodity C.

After the commodity C moves to the anteroposterior directional center CL of the commodity receiving unit 114 and stops, by the operations of the motor 116*a* of the second driving unit 116 and the motor 117*a* of the third driving unit 117 the commodity receiving unit 114 moves to a position facing the commodity takeout port 110 (refer to FIG. 1) in the longitudinal direction and stops (step S5 in FIG. 10).

When a purchaser inserts his hand from the commodity takeout port 110 and takes out the commodity C from the commodity receiving unit 114, it is detected by the sensor of a not-illustrated optical switch that the commodity C is removed from the commodity receiving unit 114 and selling completion is determined by the detection signal (step S6 in FIG. 10). After selling is completed, the commodity receiving unit 114 is returned to the waiting position (step S7 in FIG. 10).

Thus, a series of commodity selling operations are completed. When another commodity C housed in another commodity housing unit 113 is received by the commodity receiving unit 114 and conveyed to the commodity takeout port 110, the procedure same as the above is executed.

According to the above-described vending machine, by recognizing the QR code 113*g* provided with each commodity housing unit 113 by the code reader 114*f* of the commodity receiving unit 114 and reading the commodity data (data including at least size of commodity) from the QR code 113*g*, it is possible to select moving distances of the belts 113*c* and 114*c* (refer to FIG. 8) when moving the commodity C to the commodity receiving unit 114 from each commodity housing unit 113 and moving distance of the belt 114*c* (refer to FIG. 9) after the commodity C moves to the commodity receiving unit 114 as optimum values for every commodity C.

That is, it is possible to accurately and smoothly move the commodity C from the commodity housing unit 113 to the commodity receiving unit 114 and move the moved commodity C to the anteroposterior directional center CL of the commodity receiving unit 114 (belt 114*c*) and stop the commodity C. Therefore, it is possible to convey the commodity C in the commodity receiving unit 114 to the commodity takeout port 110 in a stable state and prevent a trouble that the commodity C drops from the commodity receiving unit 114 in the conveying process.

In short, because it is possible to obtain the commodity data required to select the operation mode of the commodity conveying unit including the commodity receiving unit 114 from the QR code 113*g* of the commodity housing unit 113, it is not necessary to previously input and store the commodity data in a memory. Moreover, even when replacing commodities, it is possible to obtain the commodity data same as the above by replacing the QR code 113*g* with another QR code corresponding to a replaced commodity.

In the case of the above-described embodiment, the QR code 113*g* is shown as means for recording commodity data. It is possible to use another code such as a one-dimensional code (bar code) or an IC chip in which the same commodity data is recorded as the recording means. When using the IC chip as recording means, it is preferable to set a receiver capable of receiving the commodity data from the IC chip instead of the code reader 114*f* to the commodity receiving unit 114 and read the commodity data by the receiver.

Moreover, in the case of the previously-described embodiment, the display plate 113*f* corresponding to a region for which recording means such as the QR code 113*g* is provided is set so that it can be seen from the outside. Therefore, it is possible to removably set a display portion including commodity price and commodity brand in the form of a seal or plate to the display plate 113*f*. In this connection, the commodity C housed in each commodity housing unit 113 and its brand can be recognized by seeing the commodity C through the commodity transparent plate 104. Therefore, it is not always necessary for the display plate 113*f* to include a commodity brand but it is allowed that the display portion includes only commodity price.

Figure 11:
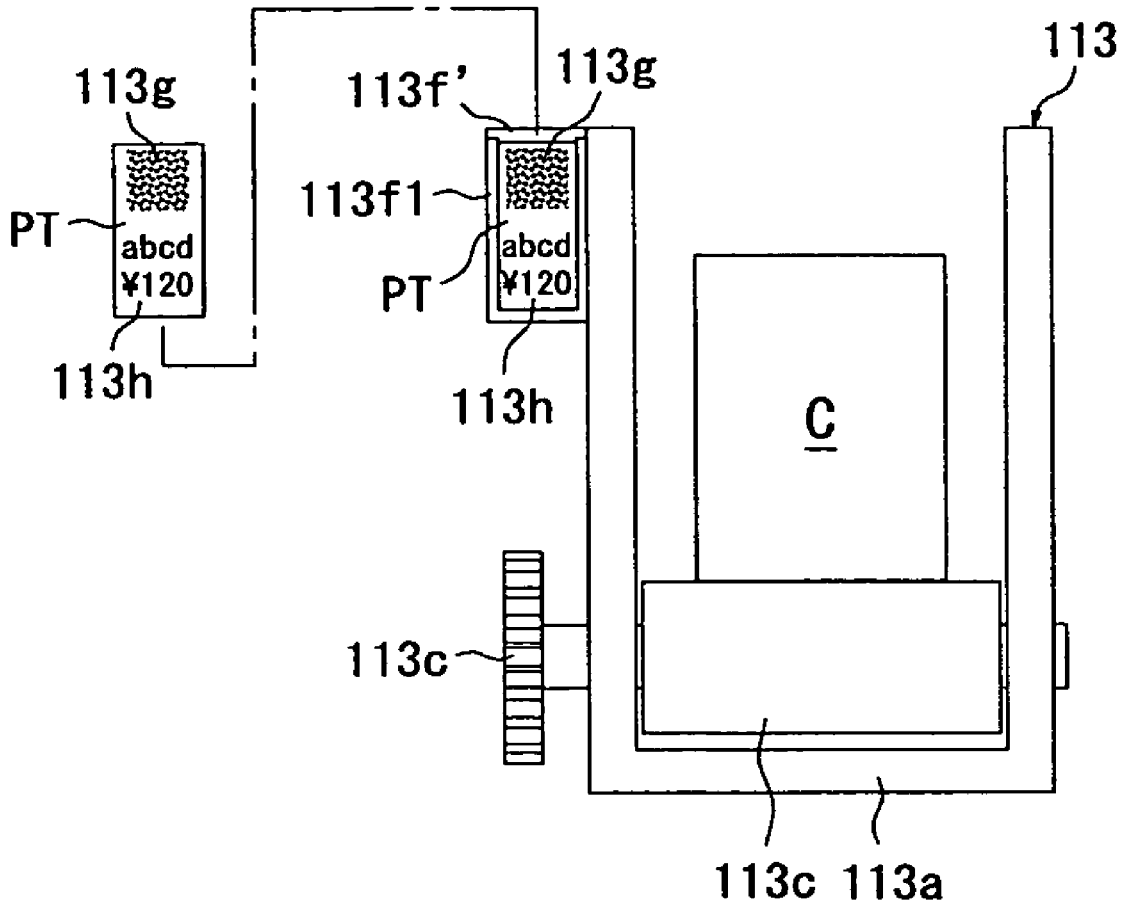
FIG. 11 is an illustration showing a structure when setting recording means and commodity price on a display plate of the vending machine shown in FIG. 1.

FIG. 11 shows a structure when setting recording means and commodity price to a display plate. An inserting frame 113*f*1 for removably inserting a rectangular display plate PT is formed on a display plate 113*f* and the display portion 113*h* including commodity price and commodity brand is printed or attached by a seal to the display plate PT in addition to the QR code 113*g*. Because this display plate PT also serves as a price display plate, it is possible to change recording means and price display at the same time by replacing the display plate PT.

Second Embodiment

FIGS. 12 to 21 show an embodiment in which the present invention is applied to a vending machine using a serpentine rack as a commodity housing unit.

Figure 12:
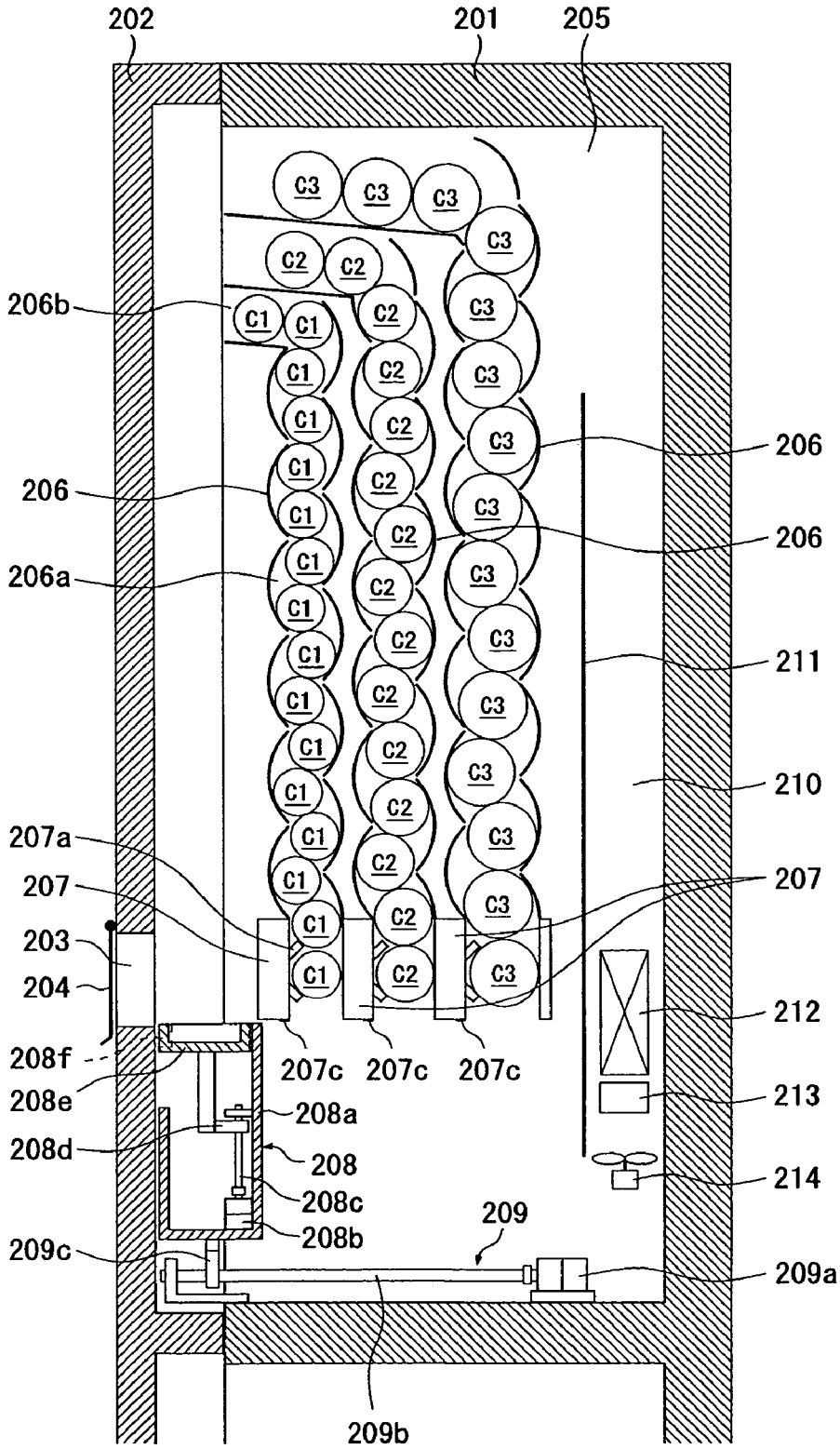
FIG. 12 is a sectional side view of an essential portion of the vending machine showing a second embodiment of the present invention.

First, a mechanism of the vending machine is described by referring to FIG. 12. FIG. 12 is a side sectional view of an essential portion of the vending machine.

This vending machine has a boxy cabinet 201 of which front open and a door 202 for covering the front opening of the cabinet 201 so that the opening can be opened or closed. A not-illustrated bill slot, coin slot, coin return lever, coin return port, selection button, commodity sample exhibiting chamber and moreover, a commodity takeout port 203 having a flap door 204 are provided on the door 202.

The cabinet 201 includes an adiabatic chamber 205. A plurality of commodity housing units 206 (three units in FIGS. 12 to 21) are provided by arranging them in the anteroposterior direction in the adiabatic chamber 205.

Each commodity housing unit 206 has a meandering hosing passage 206*a* and a commodity replenishing port 206*b* provided with the upper end of the housing passage 206*a*. The commodities (C1 to C3) are accumulated and housed in the housing passage 206*a*. In this connection, the left commodity housing unit 206 in FIG. 12 houses the commodity C1 having a small diameter and the central commodity housing unit 206 in FIG. 12 houses the commodity C2 having a diameter larger than that of the commodity C1, and the right commodity housing unit 206 in FIG. 12 houses the commodity C3 having a diameter larger than that of the commodity C2.

A vent mechanism 207 for dropping and conveying the lowest commodity (C1 to C3) in the housing passage 206*a* one by one is provided with the lower end of each commodity housing unit 206. Each vent mechanism 207 has a lever 207*a* for supporting the lowest commodity (C1 to C3) and its upper side commodity (C1 to C3), and a solenoid 207*b* (refer to FIG. 2) for driving the lever 207*a*. Moreover, a two-dimensional code (hereinafter referred to as QR code) 207*c* in which a commodity data including shape, size, and type of the commodity (C1 to C3) or the commodity data including at least the size of the commodity is recorded is removably provided with the bottom of each vent mechanism 207 in the form of a seal or plate. The QR code 207*c* corresponds to "data recording portion" in claims.

Moreover, a commodity receiving unit 208 is arranged in the lower-side space of each vent mechanism 207 in the cabinet 201. A first driving unit 209 for moving the commodity receiving unit 208 in the anteroposterior direction is provided with the lower side of the commodity receiving unit 208. These commodity receiving unit 208 and first driving unit 209 correspond to "commodity conveying unit" in claims.

The commodity receiving unit 208 has a frame 208*a* having an upper-face-opened rectangular-parallelepiped, reducer-provided motor 208*b* provided with the bottom in the frame 208, ball screw 208*c* connected to the rotational shaft of the motor 208*b*, nut 208*d* screwed with the ball screw 208*c*, receiving vessel 208*e* connected to the nut 208*d*, code reader 208*f* provided with the receiving vessel

208*e*, and a guide mechanism (not illustrated) for guiding vertical movement of the receiving vessel 208*e*.

The code reader 208*f* is constituted of a CCD camera, CMOS camera or the like and is able to read the commodity data from the QR code 207*c* of each commodity housing unit 206. The code reader 208*f* corresponds to "data reading means" in claims.

The first driving unit 209 has a reducer-provided motor 209*a*, ball screw 209*b* connected to the rotational shaft of the motor 209*a*, nut 209*c* which is screwed to the ball screw 209*b* and one end of which is connected to the frame 208*a* of the commodity receiving unit 208, and guide mechanism (not illustrated) for guiding longitudinal movement of the commodity receiving unit 208.

It is allowed that a combination of a ball screw and a nut used for the commodity receiving unit 208 and first driving unit 209 is constituted of another movement converting means constituted of a combination of a driving pulley connected to the rotational shaft of a motor, driven pulley, and endless belt wound on these pulleys.

Moreover, a wall board 211 for forming a duct 210 is arranged in the rear space of the commodity housing unit 206 in the cabinet 201. An evaporator 212 for cooling commodities, electric heater 213 for heating commodities, and fan 214 for circulating cooled air or heated air are set in the duct 210.

FIG. 12 shows an internal mechanism including an adiabatic chamber 205 and commodity housing unit 206 and commodity conveying unit housed in the adiabatic chamber 205. This vending machine has a plurality of adiabatic chambers 205 in horizontal direction and the internal mechanism shown in FIG. 12 for every adiabatic chamber 205. It is allowed to use the commodity takeout port 203 in common by forming it long from side to side. However, it is also allowed to prepare a commodity takeout port corresponding to every adiabatic chamber 205.

Then, a control system of the vending machine is described below by referring to FIG. 13.

Figure 13:
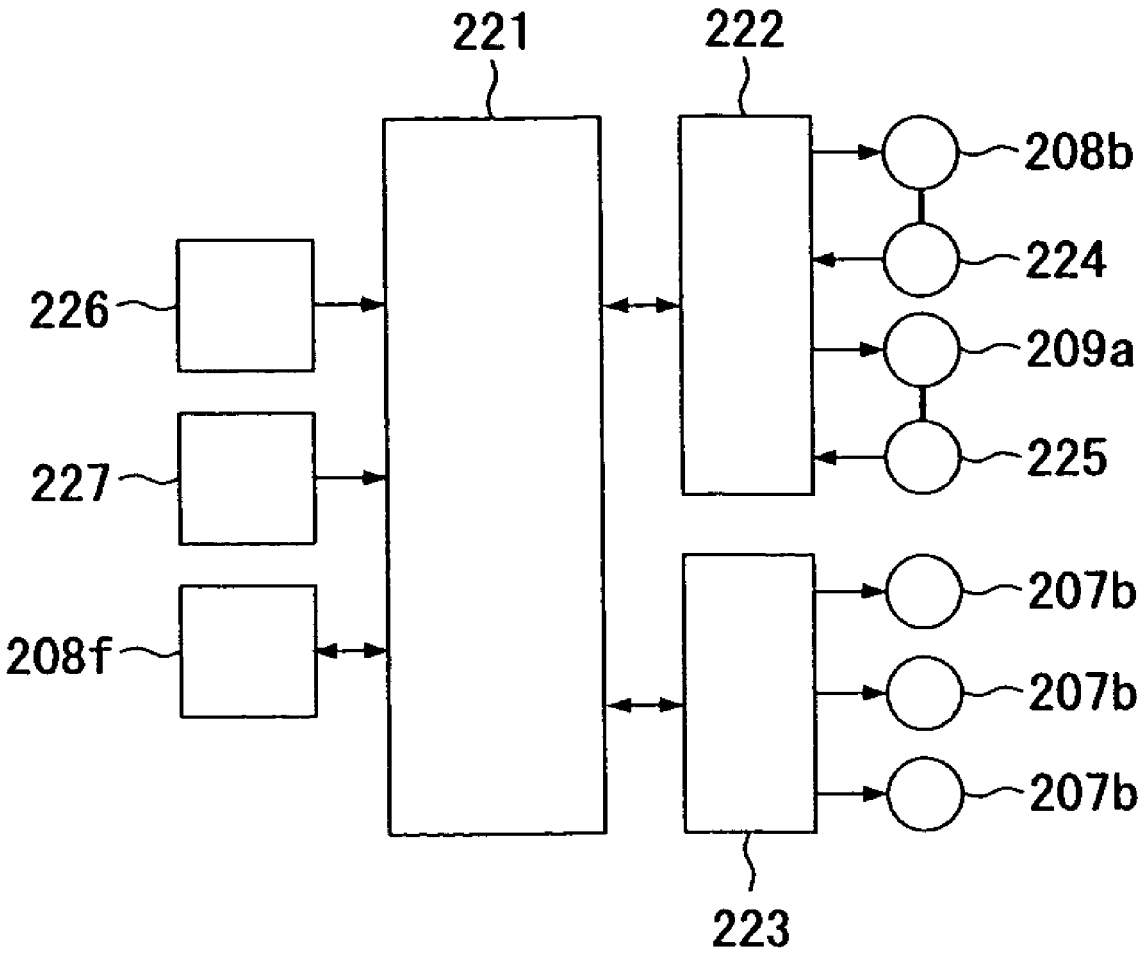
FIG. 13 is an illustration showing a control system of the vending machine shown in FIG. 12.
Figure 14:
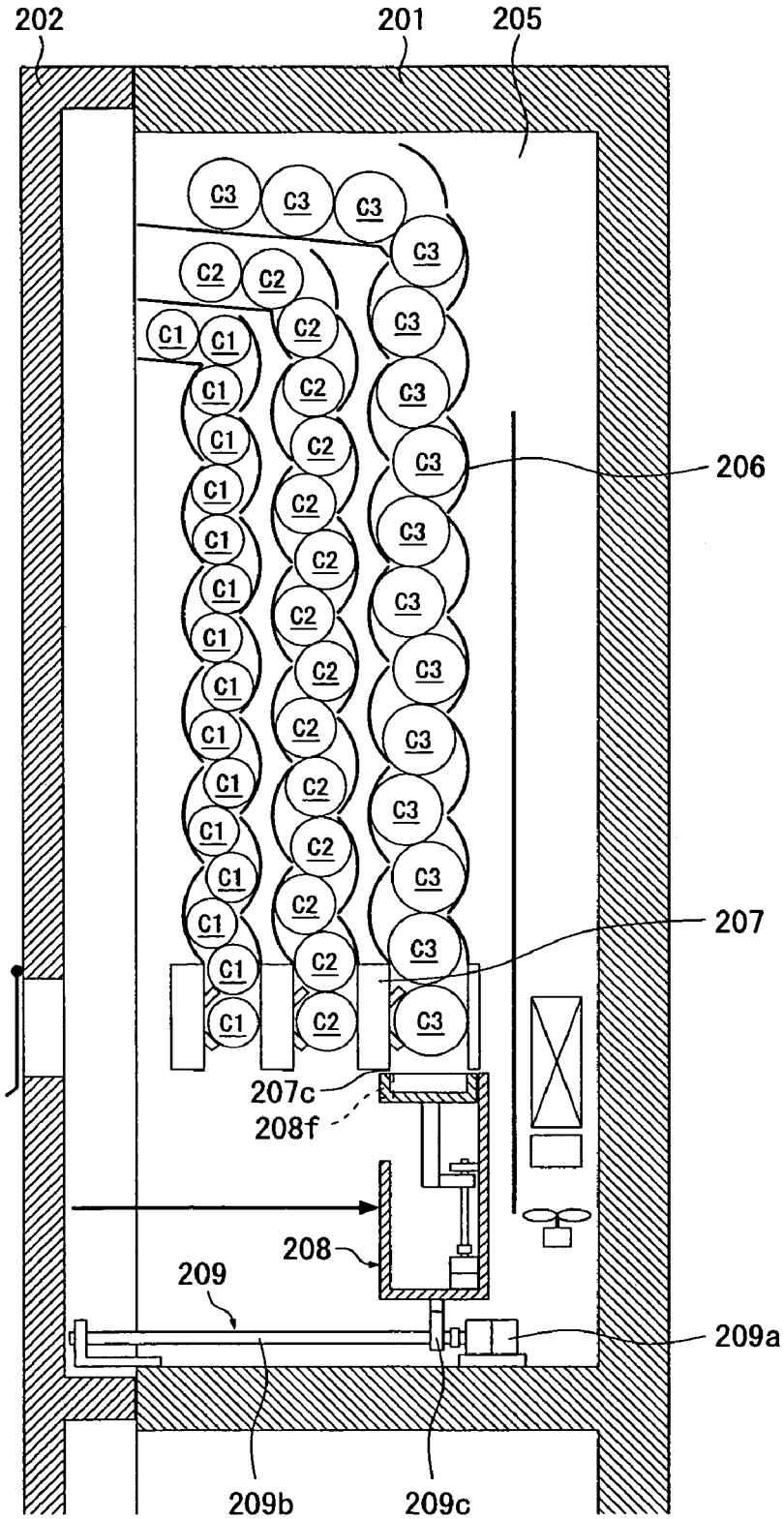
FIG. 14 is an illustration of a commodity selling operation of the vending machine shown in FIG. 12.
Figure 15:
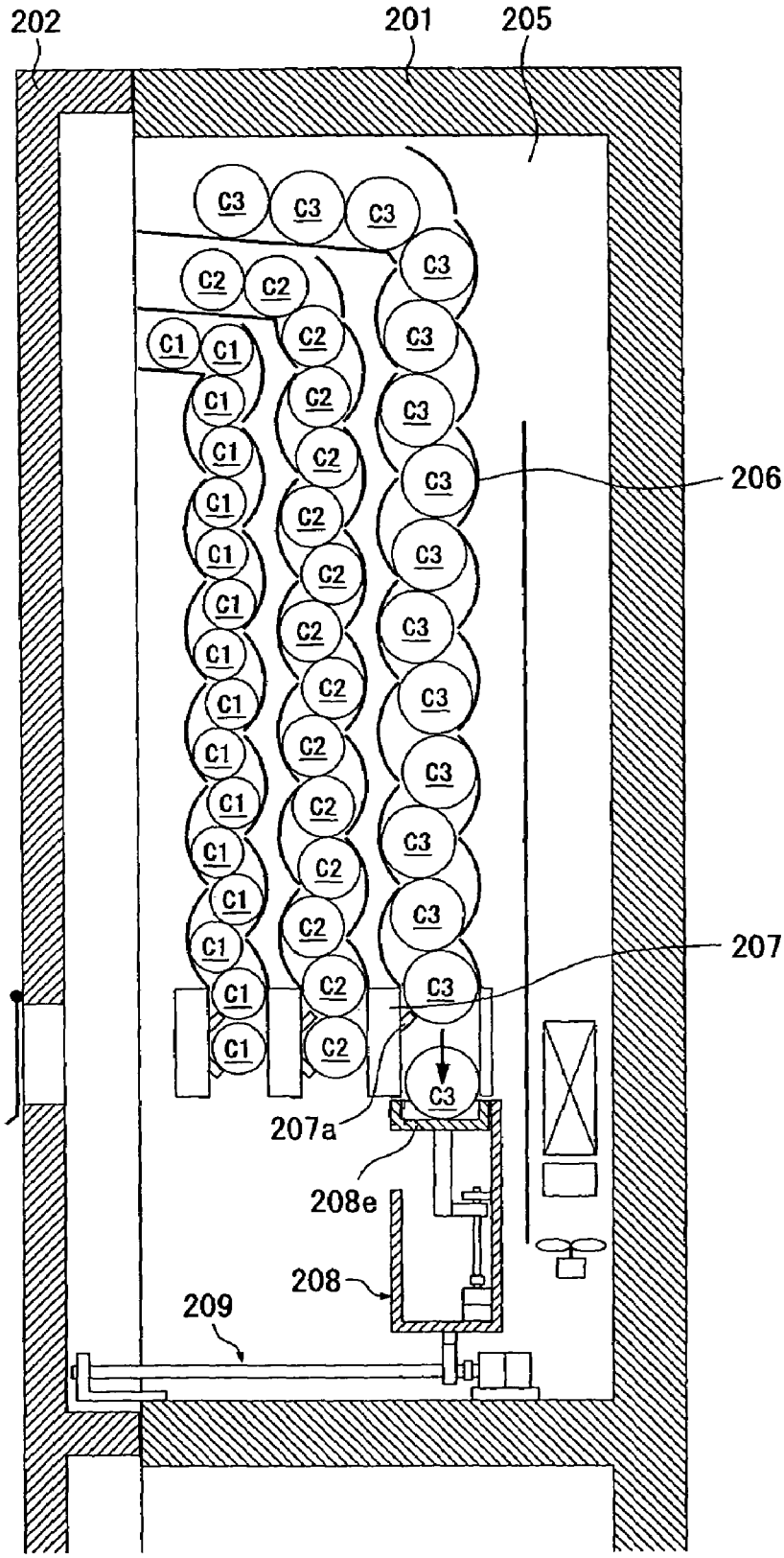
FIG. 15 is an illustration of the commodity selling operation of the vending machine shown in FIG. 12.

Reference numeral 221 in FIG. 13 denotes a control portion constituted of a microcomputer, reference numeral 222 denotes a motor driving portion, reference numeral 223 denotes a solenoid driving portion, reference numeral 224 denotes an encoder connected to the rotational shaft of the motor 208*b* of the commodity receiving unit 208, reference numeral 225 denotes an encoder connected to the rotational shaft of the motor 209*a* of the first driving unit 209, reference numeral 226 denotes a money processing unit, reference numeral 227 denotes a commodity selecting unit, and reference numeral 208*f* denotes the code reader 208*f* of the commodity receiving unit 208.

Figure 21:
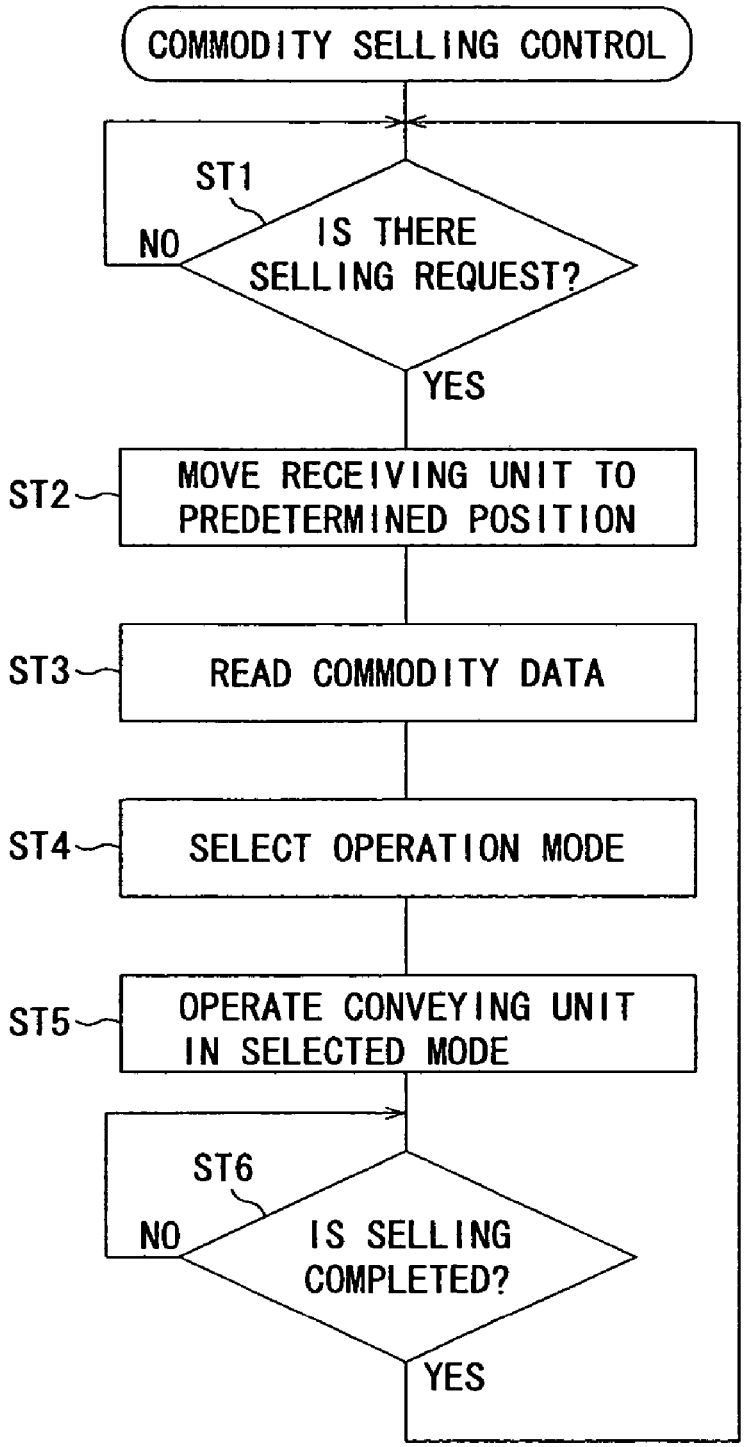
FIG. 21 is an illustration showing a program flow of a commodity selling control of the vending machine shown in FIG. 12.

The program for commodity selling control shown in FIG. 21 is stored in the memory of the control portion 221 and stop position data for the commodity receiving unit 208 for conveying a commodity is stored as one-dimensional coordinates (coordinates expressed by Y showing horizontal position). The motor driving portion 222 transmits a driving signal to the motors 208*b* and 209*a* in accordance with a control signal from the control portion 221 and transmits a detection signal of the encoders 224 and 225 to the control portion 221. The solenoid driving portion 223 transmits a driving signal to each solenoid 207*b* in accordance with a control signal from the control portion 221.

The money processing unit 226 includes a bill slot and coin slot formed on a door, performs authenticity determination of inserted money, amount-of-money detection, and storage and transmits a signal for detected amount of money to the control portion 221. The commodity selecting unit 227 includes a selection button provided with the door and transmits a selection signal to the control portion 221 in accordance with the operation of the selection button.

Then, a selling operation of the commodity is described by referring to FIGS. 14 to 21.

When a selling request for the commodity C3 for example is transmitted in accordance with money insertion and selection button operation, the commodity receiving unit 208 at a waiting position moves to a position facing the commodity housing unit 206 for housing the commodity C3 according to a selling request in vertical direction and stops (steps ST1 and ST2 in FIG. 21).

After the commodity receiving unit 208 stops, the QR code 207*c* of the commodity housing unit 206 is recognized by the code reader 208*f* while performing dedicated illumination according to necessity to read the commodity data (data including at least size of commodity) from the QR code 207*c* and an operation mode of the commodity conveying unit is selected in accordance with the commodity data which is read by the code reader 208*f* (steps ST3 and ST4 in FIG. 21).

An "operation mode" selected in this stage is a falling distance (refer to FIGS. 16, 19, and 20) of the receiving vessel 208*e* after receiving the commodity C3 and the falling distance is selected as a value optimum to the commodity C3.

After reading the commodity data, the lever 207*a* rotates by a predetermined angle and the lowest commodity C3 drops into the receiving vessel 208*e* in accordance with the operation of the solenoid 207*b* of the vent mechanism 207 corresponding to the commodity C3. Because the height position of the receiving vessel 208*e* is as close to the vent mechanism 207 as possible, the commodity C3 is not damaged when the receiving vessel 208*e* drops.

Figure 16:
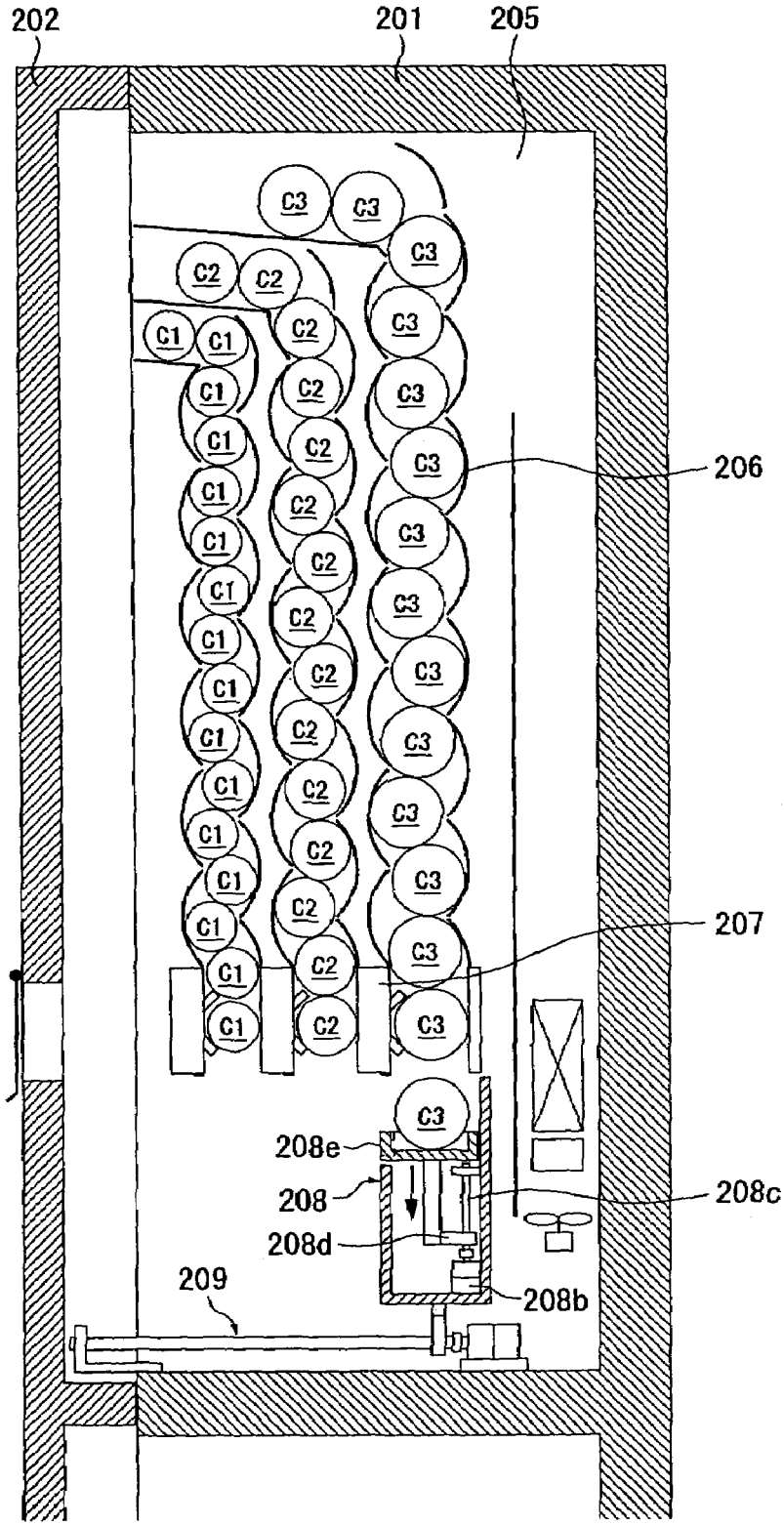
FIG. 16 is an illustration of the commodity selling operation of the vending machine shown in FIG. 12.
Figure 19:
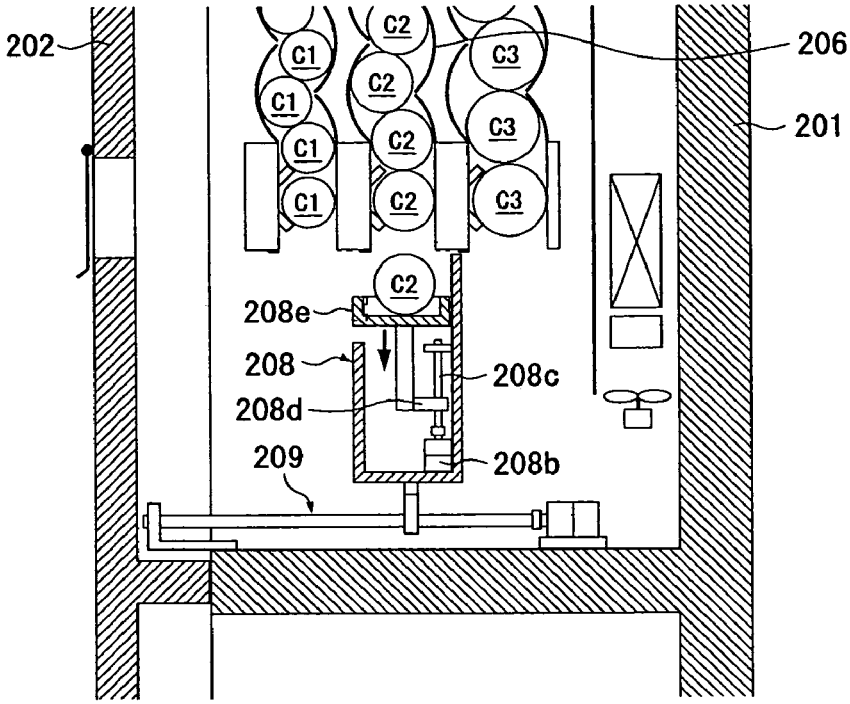
FIG. 19 is an illustration of the commodity selling operation of the vending machine shown in FIG. 12.
Figure 20:
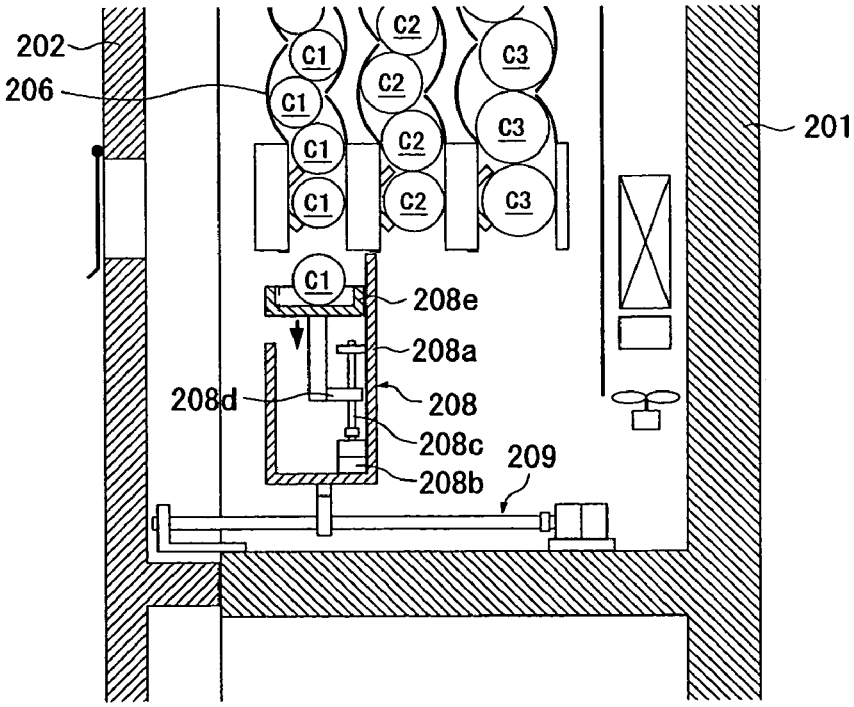
FIG. 20 is an illustration of the commodity selling operation of the vending machine shown in FIG. 12.

After the commodity C3 is received by the receiving vessel 208*e*, the receiving vessel 208*e* is lowered by a previously selected distance in accordance with the operation of the motor 28*b* of the commodity receiving unit 208 as shown in FIG. 16, the commodity receiving unit 208 becomes a state in which the commodity receiving unit 208 can advance, that is, a state in which the commodity C3 in the receiving vessel 208*e* does not interfere with the vent mechanism 207 even if the commodity receiving unit 208 advances. In this connection, this lowering distance basically conforms to the vertical dimension of the commodity. The lowering distance of the commodity C2 is smaller than that of the commodity C3 as shown in FIG. 19, and the lowering distance of the commodity C1 is smaller than that of the commodity C2 as shown in FIG. 20.

Figure 17:
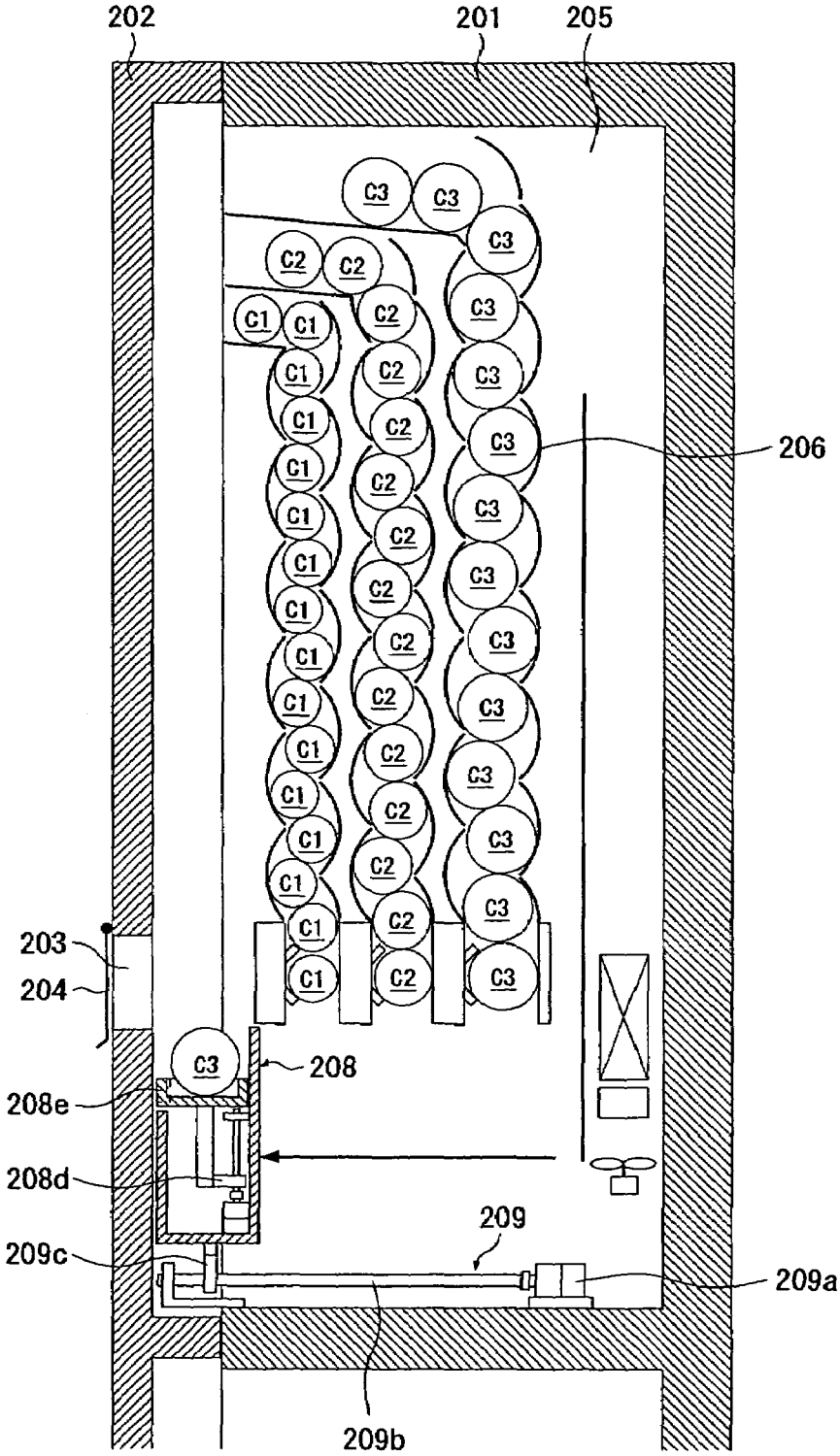
FIG. 17 is an illustration of the commodity selling operation of the vending machine shown in FIG. 12.
Figure 18:
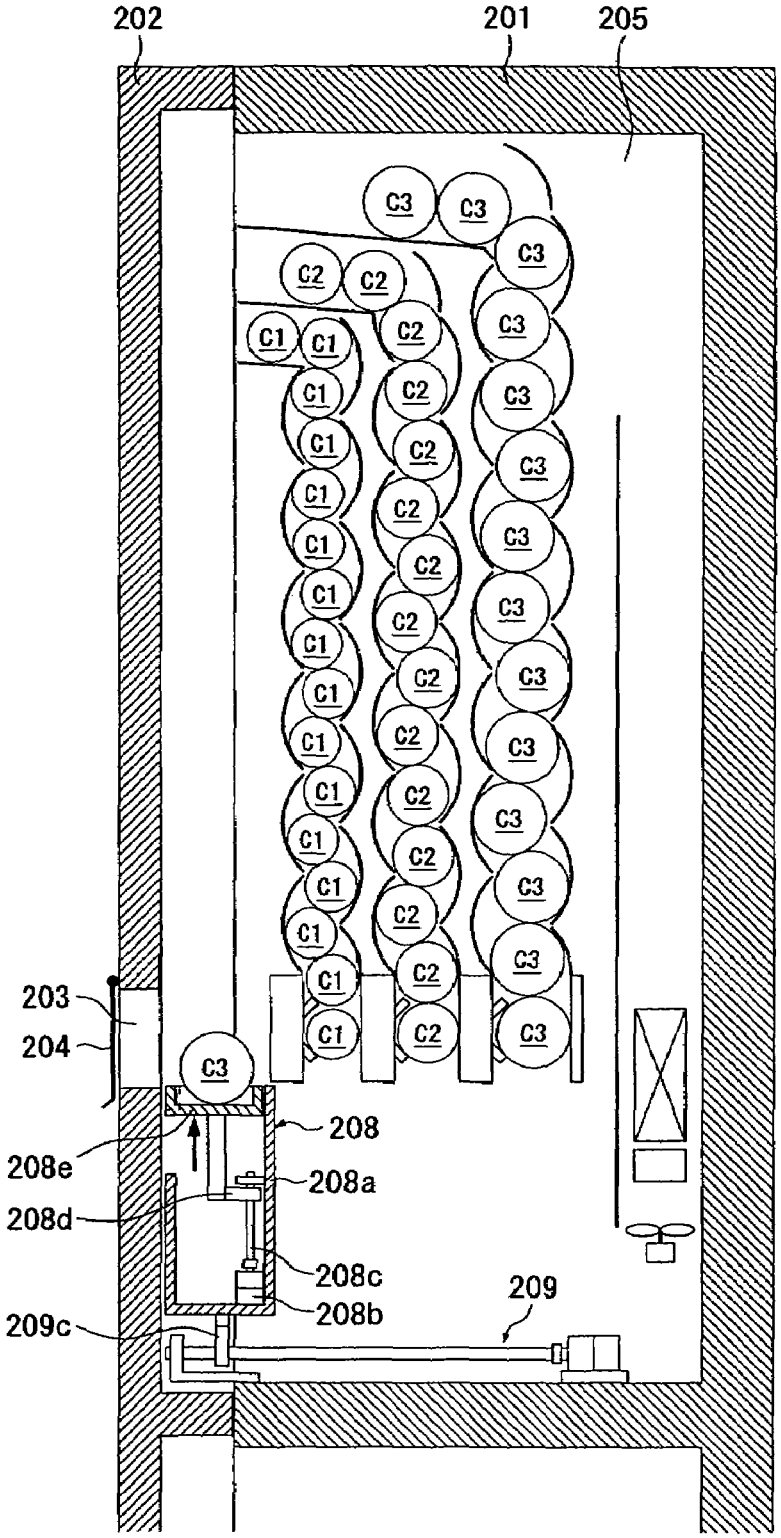
FIG. 18 is an illustration of the commodity selling operation of the vending machine shown in FIG. 12.

After the receiving vessel 208*e* lowers, the commodity receiving unit 208 is returned to the waiting position in accordance with the operation of the motor 209*a* of the first driving unit 209 as shown in FIG. 17. Then, after the commodity receiving unit 208 is returned to the waiting position, the receiving vessel 208*e* is raised to an initial position and stopped in accordance with the operation of the motor 208*b* of the commodity receiving unit 208 as shown in FIG. 18 (step St5 in FIG. 21).

When a purchaser inserts his hand from the commodity takeout port 203 and takes out the commodity C3 in the receiving vessel 208*e*, it is detected that the commodity C3 is eliminated from the receiving vessel 208*e* by a sensor of a not-illustrated optical switch and selling completion is determined by the detection signal (step ST6 in FIG. 21).

Then a series of commodity selling operations is completed. when another commodity C1 or C2 housed in other commodity housing unit 206 is received by the commodity receiving unit 208 and conveyed to the commodity takeout port 110, the procedure same as the above is executed.

According to the above-described vending machine, by recognizing the QR code 207*c* provided with the bend mechanism 207 of each commodity housing unit 206 by the code reader 208*f* of the commodity receiving unit 208 and reading the commodity data (data including at least size of commodity) from the QR code 207*c*, it is possible to select the lowering distances of the receiving vessel 208*e* (refer to FIGS. 16, 19, and 20) after receiving commodities C1 to C3 as an optimum value for every commodities C1 to C3 in accordance with the read commodity data.

That is, by changing the lowering distance of the receiving vessel 208*e* in accordance with the vertical dimension of each of the commodities C1 to C3, it is possible to decrease the time until advancement of the commodity receiving unit 208 is started after receiving the commodities and quickly perform the commodity conveying operation and prevent the commodities C1 to C3 from being damaged when they drop by making it possible to bring the height position of the receiving vessel 208*e* to the position as close to the vent mechanism 207 as possible.

In short, because it is possible to obtain the commodity data required to select the operation mode of the commodity conveying unit including the commodity receiving unit 208 from the QR code 207*c* of the commodity housing unit 206, it is not necessary to previously input and store the commodity data into a memory. Moreover, even when replacing commodities, it is possible to obtain the commodity data same as the above by replacing the QR cord 207*c* with another QR cord corresponding to a replaced commodity.

In the case of the above-described embodiment, the QR code 207*c* is shown as means for recording commodity data. It is possible to use another code such as a one-dimensional code (bar code) or an IC chip in which the same commodity data is recorded as the recording means. When using the IC chip as recording means, it is preferable to set a receiver capable of receiving the commodity data from the IC chip instead of the code reader 208*f* to the receiving vessel 208*e* and read the commodity data by the receiver.

Moreover, in the case of the above-described embodiment, the serpentine rack is shown as the commodity housing unit 206. However, the same effect can be obtained even if using another accumulating rack using a flapper mechanism as the commodity housing unit to drop and discharge a commodity.

Preferable embodiments described in this specification are illustrative only and they are not restrictive. The scope of the invention is shown by attached claims and all modifications included in the claims are included in the present invention.

What is claimed is:

1. A vending machine comprising:

a plurality of commodity housing units;

a commodity conveying unit for conveying a commodity received from a predetermined commodity housing unit to a predetermined position;

a plurality of data recording portions being provided with the commodity housing units respectively, the data recording portions each having commodity data corresponding to the commodity in each of the commodity housing units;

data reading means being provided with the commodity conveying unit, the data reading means capable of reading the commodity data from one of the data recording portions;

mode selecting means for selecting an operation mode of the commodity conveying unit in accordance with the commodity data which is read by the data reading means; and operation control means for operating the commodity conveying unit in accordance with the operation mode which is selected by the mode selecting means.

2. The vending machine according to claim 1, wherein the commodity data includes at least commodity size.

3. The vending machine according to claim 1, wherein each of the data recording portions includes an code; and the data reading means includes a code reader capable of reading the code.

4. The vending machine according to claim 1, wherein each of the data recording portions includes an IC chip; and the data reading means includes a receiver capable of receiving the commodity data from the IC chip.

5. The vending machine according to claim 1, wherein each of the commodity housing unit has a region for setting a data recording portion; and a display portion including at least commodity price is provided with the portion.

6. The vending machine according to claim 5, wherein the data recording portion and the display portion are provided with a plate removably attached to the region.

* * * * *